US005655590A

United States Patent [19]

Bryant

[11] Patent Number: 5,655,590

[45] Date of Patent: Aug. 12, 1997

[54] WINDOW BLIND WITH STORAGE RAIL

[76] Inventor: David C. Bryant, 5562 N. Elston Ave., Chicago, Ill. 60630

[21] Appl. No.: 444,270

[22] Filed: May 18, 1995

[51] Int. Cl.[6] ..... E06B 9/30

[52] U.S. Cl. ..... 160/168.1; 160/178.1

[58] Field of Search ..... 160/173 R, 168.1 R, 160/176.1 R, 178.1 R, 178.3 R, 177 R

[56] References Cited

U.S. PATENT DOCUMENTS

| | | | |
|---|---|---|---|
| 2,416,530 | 2/1947 | Lidin . | |
| 2,592,995 | 4/1952 | Anderle . | |
| 2,616,496 | 11/1952 | Junkunc . | |
| 2,618,329 | 11/1952 | Nelson . | |
| 2,627,917 | 2/1953 | Lino | 160/173 R |
| 2,697,487 | 12/1954 | Nelson | 160/173 R |
| 2,756,816 | 7/1956 | Radel et al. | 160/173 R |
| 2,838,110 | 6/1958 | Lando . | |
| 2,861,631 | 11/1958 | Anderle . | |
| 2,884,052 | 4/1959 | Lando et al. . | |
| 3,485,285 | 12/1969 | Anderle . | |
| 4,638,166 | 1/1987 | Baudro . | |
| 5,285,838 | 2/1994 | Rapp et al. | 160/176.1 R X |

FOREIGN PATENT DOCUMENTS

| | | |
|---|---|---|
| 1067458 | 12/1954 | France . |

*Primary Examiner*—Blair Johnson

[57] ABSTRACT

A window blind having a bottom rail that defines a channel for receiving and storing unnecessary or unused slats of the blind to enable the ready customization of the blind to fit windows of different heights. End caps removably engageable with the ends of the storage rail are provided for maintaining the slats within the channel. U-shaped slots may be formed on each of the leading edges of the end caps, extending inwardly for receiving and retaining a cover slat to enclose the storage rail and enhance the aesthetic appearance of the storage rail. Means may also be provided for readily securing the storage rail to the cords of the blind. The securing means comprises a slot formed on the bottom of the storage rail that slidingly engages twist-and-lock eyelets joined to the ends of the cords.

41 Claims, 1 Drawing Sheet

WINDOW BLIND WITH STORAGE RAIL

FIELD OF THE INVENTION

The present invention relates to window blinds, and, more particularly, to customization of window blinds to fit windows of different heights.

BACKGROUND

Most commercially-available window blinds comprise a plurality of interconnected slats, a bottom rail or bar that usually is heavier than the individual slats to keep the blind relatively taut, and a head rail. A pair of vertical cords and a pair of ladder tapes interconnect the slats, the bottom rail and the head rail. The vertical cords are usually secured to the rail by plugs or caps that are received within apertures formed in the rail. A wand or tilt bar that is operably attached to the rungs of the ladder tapes is also included for tilting the slats. A pull cord is included for raising and lowering the blind.

Installation of most commercially-available window blinds within a window frame is tedious and time consuming and usually involves two stages. First, the installer secures the window blind to the window frame, which requires the use of tools, brackets and screws; and next, the installer shortens the window blind to fit it within the window frame and also to achieve equal spacing between the slats for aesthetic and functional reasons.

The second stage, which itself is tedious and time consuming, usually involves several steps. The installer first lowers the blind so that the bottom rail rests on the window sill. Next, the installer removes from underneath the bottom rail the plugs or caps that are secured within the apertures formed in the rail. The installer then unties the vertical cords extending underneath the rail, and separates the bottom rail from the blind by pulling it from the rungs of the ladder tapes. Next, the installer manually disconnects the desired number of slats from the vertical cords and pulls it from the rungs of the ladder tapes.

Thereafter, the installer re-connects the bottom rail to the blind by first re-inserting the bottom rail into the appropriate rungs of the ladder tapes. The cords are then inserted through the apertures of the rail and the lift cords are re-tied underneath the rail. The excess ladder tape rungs extending underneath the rail are then cut off with a scissors, and a cover slat is inserted on the top of the bottom rail. The caps are then replaced on the bottom rail.

Because of the difficulties and time spent in installing a window blind, individuals installing blinds for their own use tend to become frustrated and often will instead choose to hire professionals to install the blind. Moreover, companies and individuals that install blinds regularly in connection with their business, such as property managers and landlords, incur countless man hours and substantial expenses installing window blinds.

Accordingly, it is an object of the present invention to provide a window blind that can be customized to the desired length quickly and easily.

It is a further object of the present invention to provide a bottom rail or bar for receiving and storing unnecessary or excess slats of the window blind to enable quick and easy shortening of the window blind.

It is a still further object of the present invention to provide a means for readily securing the rail to the window blind.

SUMMARY

In accordance with these and other objects, a bottom rail or bar for a window blind is provided in the form of a container for receiving and storing unnecessary or excess slats of the blind. The container enables the blind to be customized readily to be used with windows of different heights without having to remove or disconnect the unnecessary slats from the rest of the blind. Because of its construction, the rail also achieves substantially equal spacing between the individual slats that extend outside the rail.

In accordance with a preferred embodiment, the rail has a generally U-shaped cross-section along its substantial length to define an open channel for receiving the slats. The rail has two open ends, and end caps may be provided that are removably engageable with the ends to retain the unnecessary slats within the channel and to enclose the ends of the channel. Inwardly-facing, U-shaped slots may be formed on the top of each removable cap for retaining a cover slat to enclose the channel and to enhance the aesthetic appearance of the rail.

To customize the window blind of the present invention, after the blind is secured to the window frame, the user manually gathers and inserts into the channel of the storage rail the unnecessary slats. Then, the user engages the removable end caps with the ends of the storage rail, which maintain the unnecessary slats within the storage rail to reduce the total length of the blind. Thereafter, the user may snap within the U-shaped slots the cover slat, which is the slat located next above the rail.

The invention may also includes means for quickly and easily securing the storage rail to the vertical cords of the blind. In accordance with a preferred embodiment, the securing means comprises a slot formed on the bottom of the storage rail and eyelets joined to the ends of the vertical cords that engage the rail within the slot and also can slide within the slot. Preferably, the eyelets are twist-and-lock eyelets that engage the rail when the eyelets are twisted. The twist-and-lock eyelets also can be readily disengaged from the rail by twisting them in the opposite direction.

The present invention provides a window blind that can be customized to fit window frames of different heights quickly and easily without the use of any tools. As a result, the window blind enables individuals to install a blind with minimal effort and without the need to consult professionals. Moreover, if the installer is an individual or company who frequently is installing window blinds on a single property or multiple properties, such as a property manager or landlord, the present invention can save countless man hours and substantial expense.

The present invention also may extend the useful life of the window blind since it enables the window blind to be quickly and easily lengthened or further shortened without the need to disconnect any of the slats of the blind. Thus, the blind can be quickly and easily switched to a different size window, if desired.

In addition, the holes that are drilled in the bottom rails of the prior art window blinds to enable the blinds to be shortened are eliminated in the present invention. As a result, the present invention saves the time and expense of drilling holes in the bottom rail and also enhances the aesthetics of the rail.

Further, the rail also provides benefits in connection with the packaging of window blinds. For example, wands are usually packed loosely with the other components of the prior art window blind assemblies, and, as a result, the wands often bend or break during storage and transport of the packages containing the assemblies. With the present invention, however, the wand can be stored within the rail during packaging, which prevents the wand from bending or breaking. Storage of the wand within the rail also reduces the amount of material needed to package the window blind assembly, thereby reducing packaging and transportation costs.

BRIEF DESCRIPTION OF THE DRAWINGS

The present invention and the advantages thereof will become more apparent upon consideration of the following detailed description when taken in conjunction with the accompanying drawings.

DESCRIPTION OF THE PREFERRED EMBODIMENTS

Figure 1:
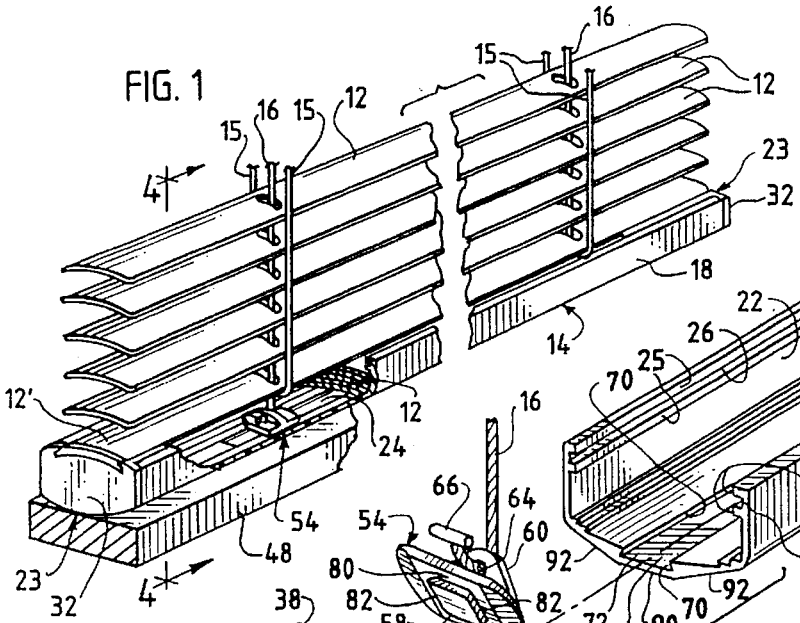
FIG. 1 is a partial perspective view of a window blind that has a bottom storage rail in accordance with one embodiment of the present invention, illustrating in a partial cutaway view the storage rail, slats retained within the storage rail, and means for securing the rail to the blind.

FIG. 1 shows a window blind 10 comprising a plurality of interconnected slats 12 and a storage rail or bar 14 in accordance with a preferred embodiment of the invention for receiving and storing one or more of the interconnected slats 12 to shorten the blind. A pair of ladder tapes 15 and a pair of vertical cords 16 interconnect the slats 12, the rail 14, and, in accordance with convention, a head rail of the blind (not shown). The ladder tapes 15 define a plurality of rungs 17 that are disposed between the slats 12 for use in connection with tilting the slats.

Figure 2:
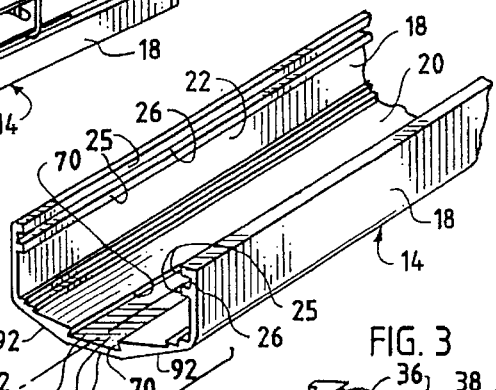
FIG. 2 is an exploded perspective view of the rail of FIG. 1 with the slats removed, illustrating a partial perspective of the rail and a perspective of one of the end caps and one of the twist-and-lock eyelets for securing the rail to the blind.

In the preferred embodiment, the storage rail 14 is located at the bottom of the blind 10 for storing one or more of the lower slats 12 of the blind. As better shown in FIG. 2, the storage rail 14 comprises a pair of opposed walls 18 and a base 20 that define an open channel 22 for receiving one or more of the lower slats 12. The cross-section of the storage rail 14 is generally U-shaped along its substantial length, and the ends of the rail are open. In addition, the bottom of the rail defines a flat bottom surface 90 that is disposed between a pair of inclined surfaces 92, which extend the substantial length of the rail.

Additionally, a longitudinally-extending and generally U-shaped slot 24 may be defined in the base of the rail by a pair of slot walls 70 that extend upwardly and inwardly at a slight angle (preferably in the range of 5° to 15°) and a bottom 72 for reasons hereinafter described. In the illustrated embodiment, the slot 24 is defined directly above the flat bottom surface 90 and also extends the substantial length of the storage rail 14.

A pair of end caps 23 may be included that are removably engageable with the ends of the rail 14 to enclose the ends of the rail. Each removable end cap 23 comprises a pair of opposed side walls 28, which are joined together by a ledge or tongue 30, and an end wall 32 that preferably is of suitable shape to completely cover the end of the channel 22. The ledge 30 extends along the substantial length of side walls 28 at or adjacent the tops of the side walls. In the illustrated embodiment, when the end caps are engaged with the rail, the side walls are received substantially within the channel 22, and the end walls 32 abut the outside ends of the rail (see FIG. 1).

End caps 34 may be engageable with storage rail 14 by lips 34 formed on the outside of side walls 28 of the end caps 23 that are slidingly received by slots 26 defined by walls 18 of the storage rail. In the illustrated embodiment, the lips 34 extend outwardly along the substantial length of the cap 23 and adjacent the tops of the side walls 28, and slots 26 are defined by a pair of extensions 25 that extend inwardly along the substantial length of the storage rail 14 adjacent the tops of the opposed walls 18. Although the lips 34 are intended to engage the removable end caps 23, they may instead (or additionally) be used to engage a cover slat for enclosing the channel 22.

Figure 3:
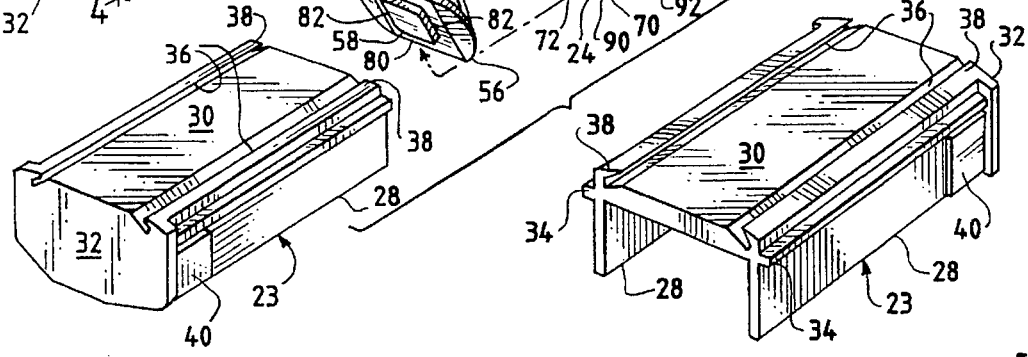
FIG. 3 is a perspective view of the other end cap of the rail of FIG. 2.

A pair of inwardly-facing slots 36 may be formed above the ledge 30 by cantilever members 38 that extend inwardly from the tops of the side walls 28. The slots 36 are adapted to receive the sides of a cover slat 12' to engage the cover slat with the end caps 23. The bottom of the cantilever 38 and sides of the ledge 30 immediately below the cantilever member 38 may be chamfered, as shown best in FIGS. 2 and 3, to compliment the slightly bowed configuration of a conventional slat.

If desired, additional structure may be included to enhance the engagement of the end cap 23 with the storage rail 14. For example, a boss 40 may be formed on the outside of the side walls 28 of the end cap 23 near the end walls 32 to increase the thickness of the side wall 28 and to enable a pressure fit engagement with the storage rail 14 when the end cap is received within the rail. In the illustrated embodiment, the boss 40 is generally rectangular. If desired, the boss 40 may be tapered. Alternatively, instead of boss 40, the outside of the side walls 28 may be tapered to enhance the engagement of the end cap 23 with the storage rail 14.

In the preferred embodiment, the unnecessary slats 12 are maintained within the channel 22 by the ledges 30 of the end caps 23, which abut the top of the uppermost slat 12 within the rail 14. It is appreciated, however, that the unnecessary slats 12 may be maintained within channel 22 in any other suitable manner, such as, for example, by one or more ledges (not shown) that are formed on the rail and extend into the channel, or by the cover slat 12'.

The width and length of the channel 22 preferably complement the width and length of the slats. For example, the width of the channel 22 preferably is in the range of ⅞" to 1⅛" for a slat that is 1" wide. Similarly, the length of the channel preferably is in the range of 23½" to 24" for a slat that is 23½" long. The height of the channel depends upon the size of the blind 10 and upon the desired aesthetics.

The height of the side walls 28 of the end caps 23 is equal to or preferably less than the height of the opposed walls 18 of the storage rail 14. The ledge 30 and side walls 28 of the end cap 23 may have any suitable length, but preferably the two lengths are approximately the same so that the ledge and side walls 28 extend approximately the same distance within the channel 22.

The window blind 10 in accordance with the preferred embodiment of the invention can be readily customized to achieve the desired height as follows. After the window blind 10 is secured to a window frame in any suitable manner, the blind is extended until the storage rail 14 rests on the sill 48. Then, the unnecessary lower slats 12 are manually gathered and inserted into the storage rail 14. The end caps 23 are then engaged with the ends of the storage rail 14, with the ledges 30 maintaining the slats within the storage rail. Next, the cover slat 12' is engaged with the slots formed in the end caps.

The customization of the blind 10 thus can be completed quickly and easily without the use of tools and without disconnecting any of the slats 12 from the blind. Moreover, substantially equal spacing desirably is achieved between the used slats of the blind (i.e. the slats not stored within the storage rail 14) when the blind is fully extended to enhance the aesthetics and operation of the blind.

If it becomes necessary, thereafter, to secure the blind to another window frame or to lengthen (or shorten further) the blind, the length of the blind can be re-customized by removing the end caps 23 and removing one or more slats 12 from the rail 14 (or inserting additional unnecessary slats 12 into the rail). The end caps 23 are then replaced on the ends of the storage rail, and another cover slat is secured to the storage rail.

Figure 4:
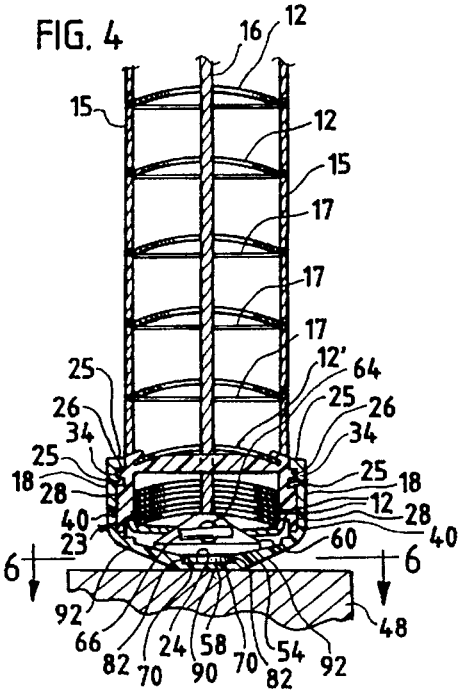
FIG. 4 is a cross section view taken along the plane 4—4 of FIG. 1.
Figure 5:
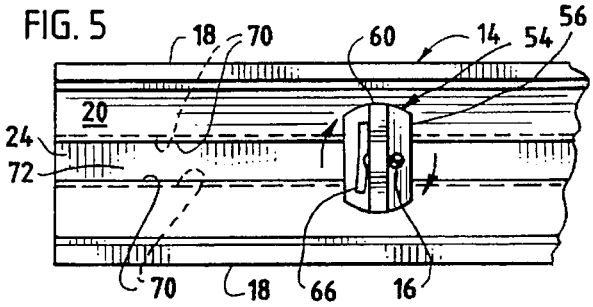
FIG. 5 is a partial plan view of the rail of FIG. 2 with one of the twist-and-lock eyelets shown received by the slot defined in the bottom of the rail, and illustrating with dashed lines the inclined walls that define the slot.

It is appreciated that the storage rail 14 also enhances the aesthetics of the blind in several respects. For example, the ladder tapes 15 extend within (and not around) the storage rail 14, leaving no ladder tapes to be seen outside the storage rail (see FIG. 4). Additionally, the inclined surfaces 92 of the storage rail 14 facilitate pivoting of the storage rail on the window sill 48 when the slats 12 are tilted. Accordingly, when the slats are tilted and the storage rail pivots onto one of the inclined surfaces, the view of the storage rail in one direction is shielded by the cover slat 12'. For example, when the slats 12 are tilted inwardly, the storage rail 14 is substantially hidden from view in the direction facing the inwardly-tilted slats.

The storage rail 14 may be constructed of any suitable material. It is appreciated, however, that the storage rail 14 may be lighter in weight than the prior art bottom rails and still function to keep the blind taut since the slats stored in the storage rail 14 increase the weight of the storage rail. Thus, the storage rail 14 preferably is constructed of a material that is rigid and lightweight, such as, for example, high impact polystyrene.

The storage rail 14 of the present invention may be secured to the window blind 10 in any suitable manner. In the preferred embodiment, however, means are provided for quickly and easily securing the storage rail 14 to the vertical cords 52. In this embodiment, the securing means comprises a pair of twist-and-lock eyelets 54 joined to the ends of cords 16, which are engageable with the base of the storage rail 14 within the slot 24.

In the illustrated embodiment, each twist-and-lock eyelet 54 comprises a member 56 having an embossment 58 on one side and a bracket 60 on the other side. The ends of the member 56 may be chamfered along its width to complement the slightly bowed configuration of the base 20 of storage rails 16. The embossment 58 and bracket 60 are preferably integral with the member 56, with the embossment extending generally parallel to the member and the bracket extending generally perpendicular to the member.

Figure 6:
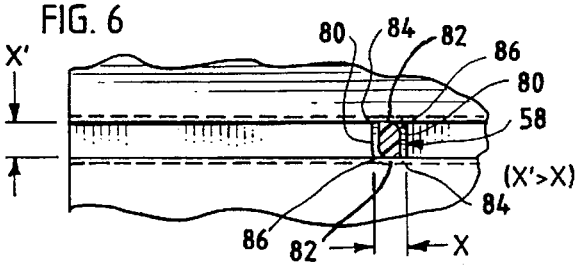
FIG. 6 is a cross section view taken along the lines 6—6 of FIG. 4, illustrating the embossment of the twist-and-lock eyelet engaged with the rail within the slot and illustrating with dashed lines the inclined walls of the slot and the inclined walls of the embossment engaged with the slot walls.

The embossment 58 is generally rectangular and is defined by a pair of parallel first walls 80 and a pair of parallel second walls 82. Preferably, the length of first walls 80 is slightly less than the width of the slot 24, and the length of second walls 82 is slightly less than the length of the first walls (as illustrated in FIG. 6). The first and second walls 80, 82 are joined together to define a pair of opposed square corners 84 and a pair of opposed rounded corners 86. As illustrated best by the dashed lines in FIG. 6, the first and second walls extend downwardly from member 56 and outwardly at a slight angle (preferably in the range of 5° to 15°) to complement the slight incline of slot walls 70 of the storage rail 14.

Each bracket 60 of eyelet 54 includes an aperture 64 for receiving one of the vertical cords 52, and a bead or tab 66 may be secured to the end of the cord to keep the cord secured to the bracket 60.

To readily secure the cords 52 to the storage rail 14, each twist-and-lock eyelet 54 is inserted into the slot 24 with first walls 80 extending in the direction of the longitudinal axis of the rail. The member is twisted approximately 90 degrees relative to the rail to cause the embossment 58 to engage slot walls 70. The twisting engagement of the embossment with the slot walls is facilitated by the rounded corners 86, and by the inclined walls 70 of the storage rail 14 and the inclined first and second walls 80, 82 of the embossment 54.

Once the twist-and-lock eyelet 54 and the storage rail 14 are engaged, the eyelets 54 can be moved to a different position along the slot 24 with manual pressure so that the cords can be secured to the storage rail 14 at the desired location. The twist-and-lock eyelets 54 can be disengaged from the rail 14 by twisting the eyelets in the reverse direction.

The foregoing description is for purposes of illustration only and is not intended to limit the scope of protection accorded this invention. The scope of protection is to be measured by the following claims, which should be interpreted as broadly as the inventive contribution permits.

What is claimed is:

1. A blind comprising a plurality of substantially horizontal slats interconnected by at least one cord, a container connected to said at least one cord receiving and storing some of the slats to reduce the length of the blind, and means for retaining said some of the slats within the container.

2. The blind of claim 1 wherein the container defines an opening for receiving said some of the slats, the opening facing the other slats and extending substantially along the length of the container.

3. The blind of claim 2 wherein the container further comprises a pair of opposed walls, and a base interconnecting the opposed walls to define the opening, the cross-section of the container being generally U-shaped substantially along the length of the container.

4. The blind of claim 2 having a bottom, the container being secured at the bottom.

5. The blind of claim 2 wherein the bottom of the container has an inclined surface to enable the container to pivot onto the inclined surface when the container is on a window sill and when the interconnected slats are tilted.

6. The blind of claim 2 wherein the container defines a channel for storing said some of the slats and the retaining means comprises at least one ledge extending into the channel.

7. The blind of claim 1 wherein the retaining means comprises at least one end cap removably engageable with an end of the container.

8. The blind of claim 7 wherein the container defines a channel for storing said some of the slats, and the end cap comprises a ledge extending into the channel.

9. The blind of claim 8 wherein the container comprises at least one pair of lips extending into the channel that define an inwardly-facing slot and the at least one end cap comprises at least one outwardly-extending extension slidably received within the slot.

10. The blind of claim 7 wherein one of the other slats is removably engageable with the at least one end cap.

11. The blind of claim 7 wherein the container has a pair of ends and there are two end caps, each end cap removably engaged with a respective end of the container.

12. The blind of claim 1 further comprising at least one end cap removably engaged with an end of the container and wherein the retaining means comprises one of the other slats removably engaged with the at least one end cap.

13. The blind of claim 1 further comprising two end caps and wherein the container two ends, each end cap removably engaged with a respective end of the container, the retaining means comprises one of the other slats removably engaged with the end caps.

14. The blind of claim 1 wherein the container has a bottom with an inclined surface to enable the container to pivot onto the inclined surface when the container is on a window sill and when the interconnected slats are tilted.

15. The blind of claim 2 wherein the container includes a base that defines a slot, the blind further comprising:

at least one cord; and means for releasably connecting the container to the at least one cord, the connecting means comprising a member secured to the at least one cord, the member being engageable with the container when at least a portion of the member is received within the slot and when the member is twisted from a first position to a second position.

16. The blind of claim 15 wherein the portion is defined by a generally rectangular boss that has two rounded corners to facilitate twisting engagement of the boss and the container, the length of the boss extending in the longitudinal direction of the slot when the member is in the first position.

17. The blind of claim 16 wherein the container has a bottom and the slot is defined by a pair of opposed slot walls that extend upwardly and slightly inwardly from the bottom of the container, and the boss has at least two side walls that extend downwardly and slightly outwardly from the member, the slots walls engaging at least two of the side walls when the member is in its second position.

18. A blind comprising a plurality of slats:

at least one cord interconnecting said slats;

a bottom rail defining a slot; and means for releasably connecting the rail to the at least one cord, the connecting means comprising a member secured to the at least one cord, the member is cause to be engaged with the rail when at least a portion of the member is received within the slot and the member is twisted from a first position to a second position.

19. The blind of claim 18 wherein the portion is defined by a generally rectangular boss that has two rounded corners to facilitate twisting engagement of the boss and the rail, the length of the boss extending in the longitudinal direction of the slot when the member is in the first position.

20. The blind of claim 19 wherein the slot is formed in the base of the rail.

21. The blind of claim 20 wherein the bottom rail has a bottom and the slot is defined by a pair of opposed slot walls that extend upwardly and slightly inwardly from the bottom of the rail, and the boss is defined by a plurality of side walls that extend downwardly and slightly outwardly from the member, the slots walls engaging at least two of the side walls when the member is in its second position.

22. A blind comprising a plurality of interconnected slats, a container for receiving and storing at least one of the slats to reduce the length of the blind, the container defining an opening for receiving the at least one slat, the opening facing the other slats and extending substantially along the length of the container, the container having at least one open end and defining a channel for storing the at least one slat, and means for retaining the at least one slat within the container, the retaining means comprises at least one end cap removably engageable with the at least one end of the container, the end cap comprising a ledge extending into the channel and two opposed end cap walls interconnected by the ledge, said at least one slat being retained substantially below said ledge.

23. The blind of claim 22 wherein the ledge extends across a portion of the opening when that at least one end cap is engaged with the container.

24. The blind of claim 23 wherein both ends of the container are open and there are two end caps.

25. The blind of claim 24 wherein a pair of inwardly-facing slots is defined on each end cap for receiving one of the other slats to substantially enclose the channel.

26. A blind comprising:

(a) a plurality of substantially horizontal slats interconnected by at least one cord;

(b) a rail connected to said at least one cord for receiving and storing some of the slats to adjust the length of the blind, the rail having a length and comprising a base and a pair of opposed side walls defining a channel that extends substantially along the length of the rail, the channel being substantially unobstructed substantially along the length and width of the rail; and (c) means for retaining said some of the slats within the channel.

27. The blind of claim 26 wherein the cross section of the rail is generally U-shaped substantially along the length of the rail.

28. The blind of claim 26 wherein the rail has at least one end and the retaining means comprises at least one end cap engageable with the end of rail.

29. The blind of claim 28 wherein one of the other slats is engageable with the at least one end cap.

30. The blind of claim 26 wherein the rail has two ends and the retaining means comprises two end caps, each end cap engageable with a respective end of the rail.

31. The blind of claim 30 wherein the ends of the rail are open, the end caps substantially enclosing the respective open ends when engaged with the respective open ends.

32. The blind of claim 26 further comprising at least one end cap engageable with an end of the container and wherein the retaining means comprises one of the other slats engageable with the at least one end cap.

33. The blind of claim 26 wherein the rail defines an opening substantially along the length of the rail for receiving said some of the slats into the rail.

34. A blind comprising:

(a) a plurality of substantially horizontal slats interconnected by at least one cord;

(b) a rail adapted to receive and store at least one of the slats to adjust the length of the blind, the rail comprising a base and a pair of opposed side walls extending from the base, each opposed side wall terminating distal of the base in an upper surface;

a cover slat comprising one of said plurality of slats positioned substantially between said upper surfaces; and (d) means for retaining the at least one slat within the rail so that the at least one slat does not extend above the upper surfaces.

35. The blind of claim 34 wherein the cross section of the rail is generally U-shaped substantially along the length of the rail.

36. The blind of claim 34 wherein the rail has at least one end and the retaining means comprises at least one end cap engageable with the end of the rail.

37. The blind of claim 36 wherein said cover slat is engageable with the at least one end cap.

38. The blind of claim 34 wherein the rail has two ends and the retaining means comprises two end caps, each end cap engageable with a respective end of the rail.

39. The blind of claim 38 wherein the ends of the rail are open, the end caps substantially enclosing the respective open ends when engaged with the respective open ends.

40. The blind of claim 34 further comprising at least one end cap engageable with an end of the container and wherein the retaining means comprises one of the other slats engageable with the at least one end cap.

41. The blind of claim 34 wherein the rail defines an opening substantially along the length of the rail for receiving said some of the slats into the rail.

* * * * *